United States Patent [19]

Sandling

[11] Patent Number: 4,557,073

[45] Date of Patent: Dec. 10, 1985

[54] REVOLVING DOORS

[75] Inventor: Kjell H. Sandling, Landskrona, Sweden

[73] Assignee: K. S. Konsult Kjell Sandling, Landskrona, Sweden

[21] Appl. No.: 546,613

[22] Filed: Oct. 28, 1983

[30] Foreign Application Priority Data

Nov. 5, 1982 [SE] Sweden ..... 8206294

[51] Int. Cl.[4] ..... E06B 3/24

[52] U.S. Cl. ..... 49/41; 109/8; 49/42

[58] Field of Search ..... 49/42, 43, 44, 40, 41; 109/2, 8

[56] References Cited

U.S. PATENT DOCUMENTS 841,696 1/1907 Lang ..... 49/42 X
4,458,447 7/1984 Heige et al. ..... 49/44

FOREIGN PATENT DOCUMENTS 254103 11/1912 Fed. Rep. of Germany .
4106 of 1909 United Kingdom ..... 49/42
1223699 3/1971 United Kingdom .

*Primary Examiner*—Kenneth Downey
*Attorney, Agent, or Firm*—Jordan and Hamburg

[57] ABSTRACT

The present invention concerns a revolving door device having arcuate screens arranged on diametrically opposite sides of the passage space constituting part of the revolving door closely adapted to the fixed outer walls of the device. Said screens being connected with each other through a partition wall divided up in three sections having the central section openable. The respective outer sections is aligned along a chord of the circular space so that when said screens are in a position for access to the respective passage spaces, a free through path may be obtained from entrance opening to the outer through the openable central section in case of emergency.

25 Claims, 12 Drawing Figures

REVOLVING DOORS

Revolving doors are a usual solution to the problem of making a boundary between an internally heated space and outdoor conditions, for example. The revolving door forms a kind of airlock, and the simpliest form thereof consists of four door leaves attached to a vertical shaft and arranged in a turnstile-like structure. The door leaves are arranged to have their outer edges gliding along cylindrically arcuate wall surfaces, which form the passage space.

On the accompanying drawings, FIG. 1 schematically illustrates a conventional revolving door seen from above. This revolving door consists of 4 door leaves 1, 2, 3, 4 mounted on a central vertical shaft 5. The outer free edges of the leaves 1–4 are disposed for gliding along cylindrical wall portions 6, 7 forming between them entrance openings 8, 9. The space formed between two door leaves, e.g. leaves 1 and 4, and the opposing cylindrical wall surface 6 can allow a through transport volume of an extension illustrated by the chain-dotted rectangle 10. The rectangle can naturally represent one or more persons or a shopping trolley, for example. There is a general desire to increase the transport space while retaining the advantages of a revolving door.

A solution of the problem mentioned is, in essentials, to arrange two curved screens diametrically opposing within a space defined by fixed cylindrical walls with openings as with a conventional revolving door. In the space between the cylindrical wall a partition wall is arranged on a diameter and such as to join onto the appropriate long edge of the arcuate screen, the screens being suspended such that they follow the curve of the cylindrical walls. There is now obtained an arrangement having two passage spaces in coaction with the surrounding cylindrical side walls simultaneously as conventional revolving door air-lock function is retained.

FIG. 2 schematically illustrates the implementation of a revolving door having only one partition wall as seen from above i.e. from the same direction of view as the revolving door to FIG. 1.

FIGS. 3 and 4 illustrate different positions of views for the door of FIG. 2.

It will be seen from FIG. 2 that the cylindrical walls 11, 12 are less than half-cylindrical to allow for the formation of entrance openings 13, 14. Between the walls 11, 12 there are arranged two screens or panels 15, 16, which are curved to suit the walls 11, 12. A rotatably mounted wall 18 is arranged between the screens 15, 16 at their forward edges in the direction of rotation 17. When the wall 18 is urged in the direction of the arrow 17, the screens 15, 16 will accompany it with their outer sides following the surfaces of walls 11, 12. In FIG. 3 it will be seen that the arrangement has been rotated so that the screen 15 covers the entrance opening 14, and the screen 16 covers the entrance opening 13. The revolving door thus blocks both entrances in this position, and if the arrangement is locked in this position obtained closing off of the entrance openings 13 and 14 is obtained.

FIG. 4 illustrates the arrangement in the position in which the wall 18 together with the respective walls 11, 12 forms the passage space 19, 20, which is more commodious than is the case with the revolving door in FIG. 1. A dashed rectangle 21 is drawn in the passage space 19 to illustrate the available space for persons or objects in passage through the revolving door. As will be seen, the arrangement is basically simple, but is a solution to the problem of increasing transport capacity through revolving doors.

The present invention is based on the type of door illustrated in FIGS. 2–4. In the implementation of revolving doors it is essential to take safety aspects into consideration as well as those of transport space. In the case of emergency evacuation of a building, revolving doors can often constitute an obstacle to passage, which in turn can easily lead to panic. The present invention relates to a solution of both the transport capacity problem and the safety problem in this type of revolving door. An essential distinguishing feature of the invention is that the partition wall denoted by 18 in FIGS. 2–4 is made in at least three sections at angles to each other. These sections are suspended in a turntable structure disposed above the door and thus have no connection with the floor substructure. Furthermore, the central section is arranged openable, so that a substantially free passage may be formed between both entrance openings. The turntable arrangement is preferably driven by machine and adapted for rotation as soon as a person enters or an object is inserted into the passage space. Further safety paths and emergency routes may be established in an arrangement in accordance with the invention. The distinguishing features of the present invention are disclosed in the following claims.

FIG. 1 schematically illustrates a conventinal revolving door seen from above.

FIG. 2 schematically illustrates the implementation of a revolving door having only one partition wall as seen from above.

FIGS. 3 and 4 illustrate different positions of views for the door in FIG. 2.

The invention will now be described in detail with reference to an embodiment illustrated in FIGS. 5–12.

FIGS. 9–12 schematically illustrate different working positions.

Figure 5:
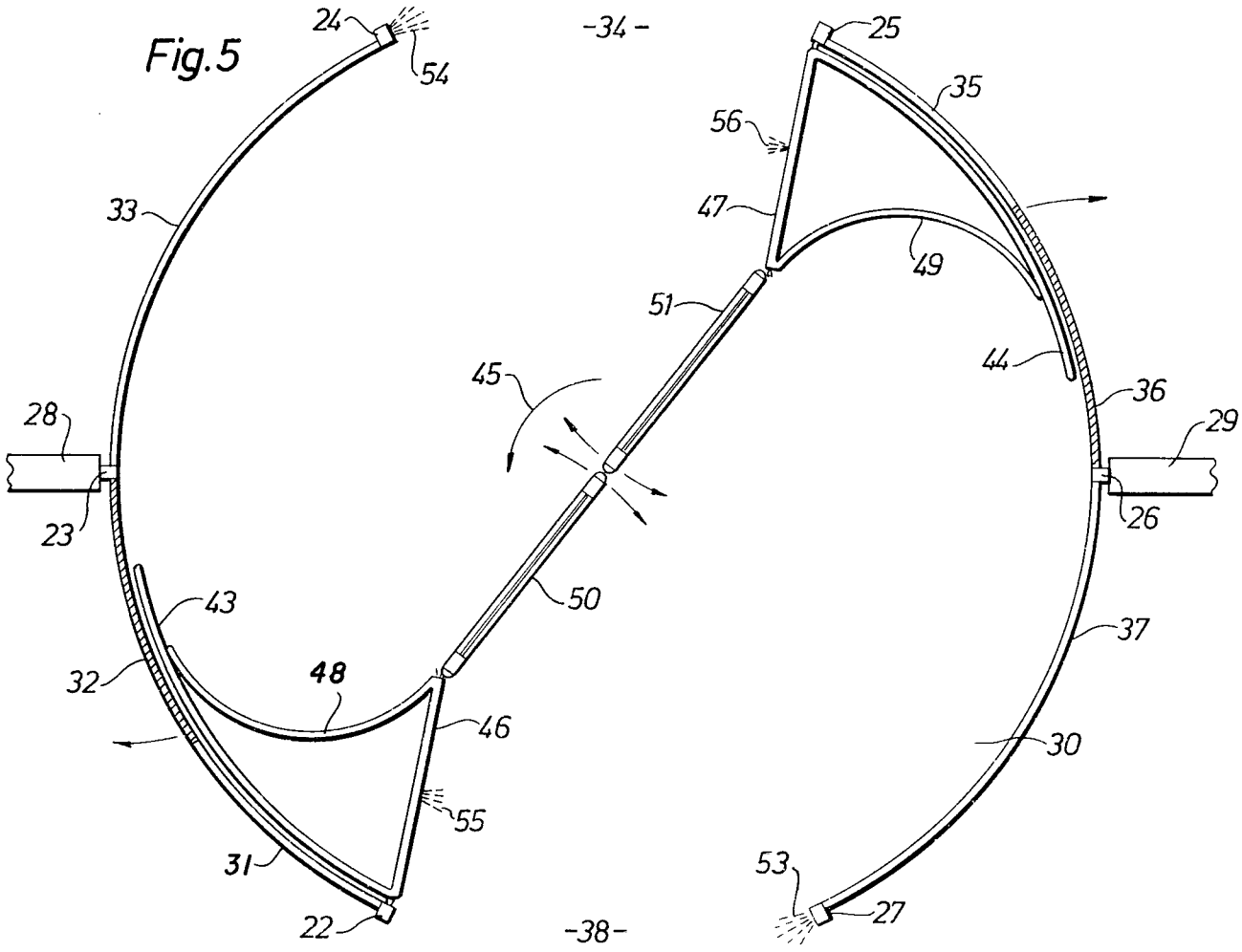
FIG. 5 illustrates the embodiment seen from above.
Figure 6:
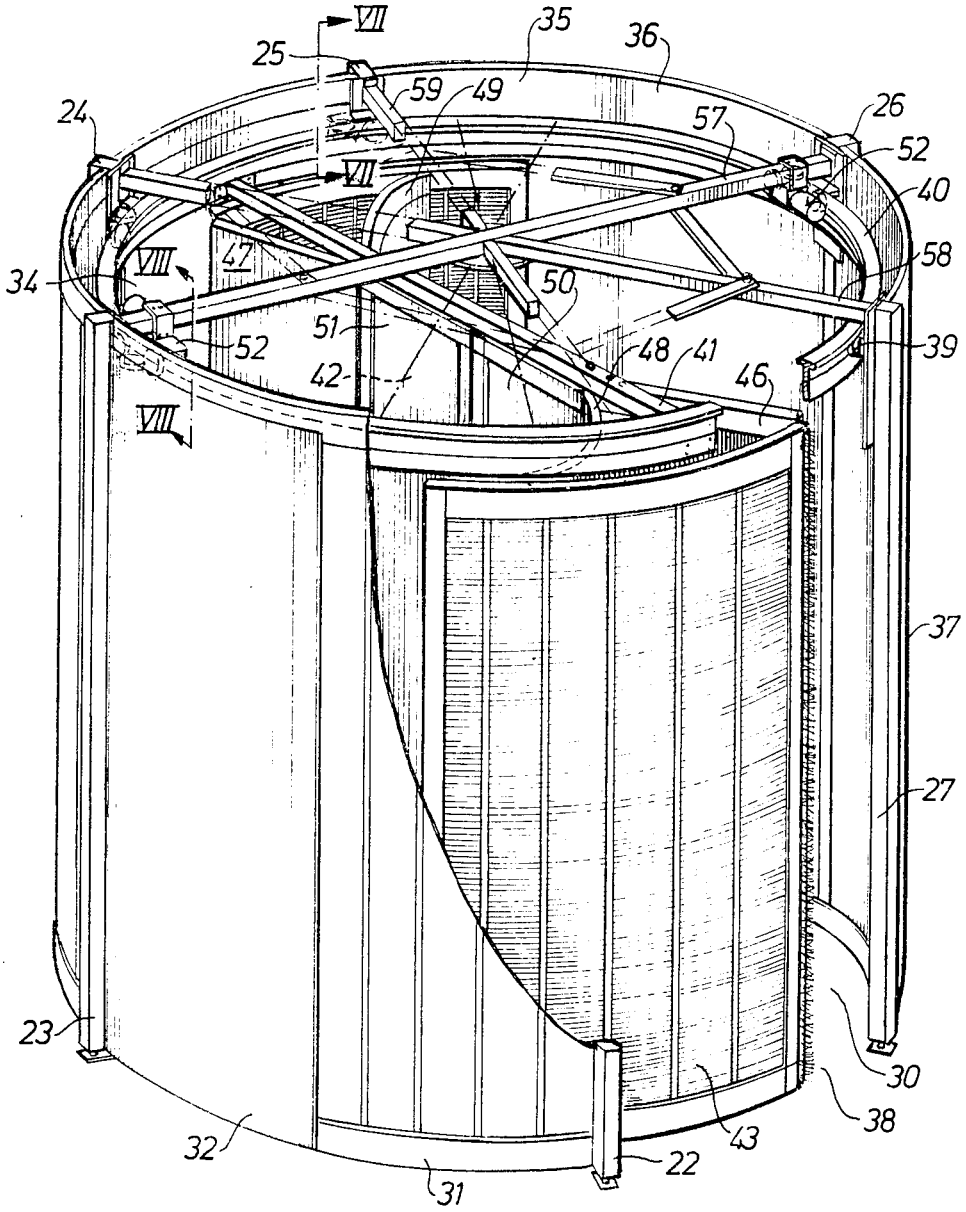
FIG. 6 illustrates the embodiment seen in perspective.

The arrangement illustrated in FIGS. 5 and 6 includes six posts 22, 23, 24, 25, 26 and 27. Posts 23 and 26 coact with the edges 28 and 29 of the opening in a wall. The posts 22–27 are fixed to the floor structure 30 in a manner not more closely illustrated. Between the posts 22 and 23 there is an arcuate wall portion 31 which is contiguous to an arcuate door pivotably suspended on the post 23 and equivalent to the wall portion 31. There is a further arcuate wall portion 33 between the post 23 and post 24. One entrance opening 34 is situated between the posts 24 and 25, there being an arcuate wall portion 35 between the posts 25 and 26, the wall portion 35, similar to the wall portion 31, being contiguous to a door 36, similar to the door 32 and suspended on the post 26. Between the post 26 and the post 27 there is a further arcuate wall portion, while the other entrance opening 38 is situated between the posts 22 and 27.

Attachments are arranged at the upper end of the posts 22–27 for rollers 39 carrying a circular rail 40, which has a T-shaped cross section. This rail carries a frame 41 in which the rotating door sections are suspended, and which also carry panels 42 formed into arcuate sectors, and which form a stiffening structure part. On diagonally opposite sides there are two arcuate panels 43 and 44 suspended in the frame 41, there being a wall portion 46 and 47, respectively, extended at an angle from the forward edges of the respective panels 43, 44 in the direction of rotation 45 of the arrangement. Between the inner end of the wall portions 46 and 47 there extend two arcuate wall panels 48 and 49 out towards the arcuate panels 43 and 44, respectively. Between the inner ends of the wall sections 46 and 47 there extend two pivotably suspended doors 50 and 51, disposed in mutual alignment. These doors are normally kept in the position illustrated in FIG. 5, but can be made to swing in an emergency by the application of a given pressure against them.

Figure 7:
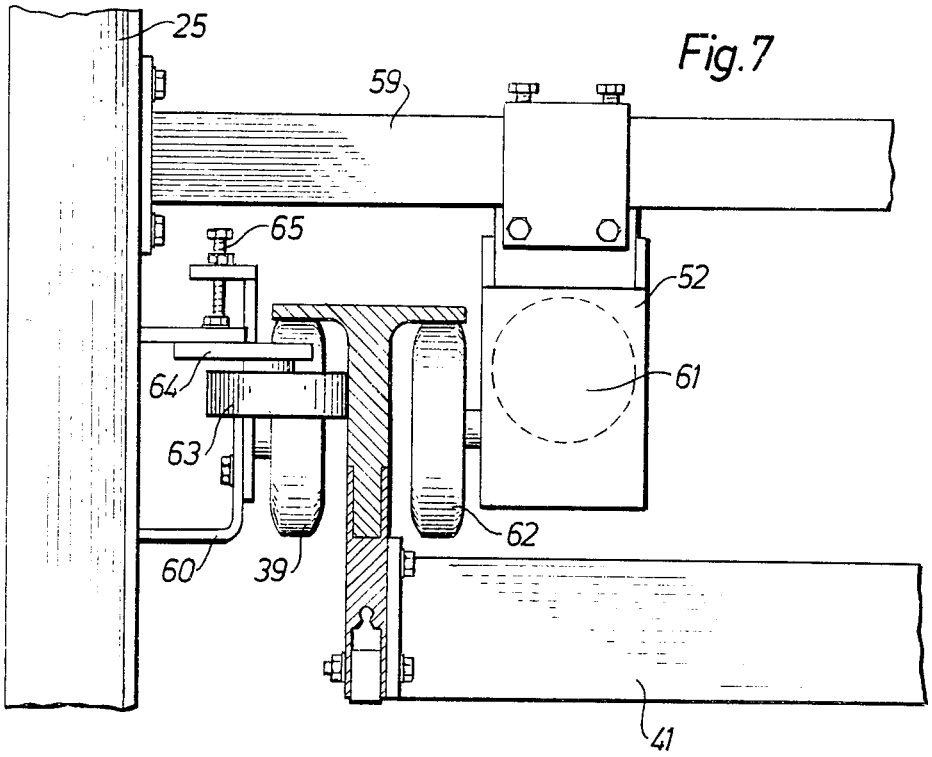
FIG. 7 is a section along the line VII—VII in FIG. 6.
Figure 8:
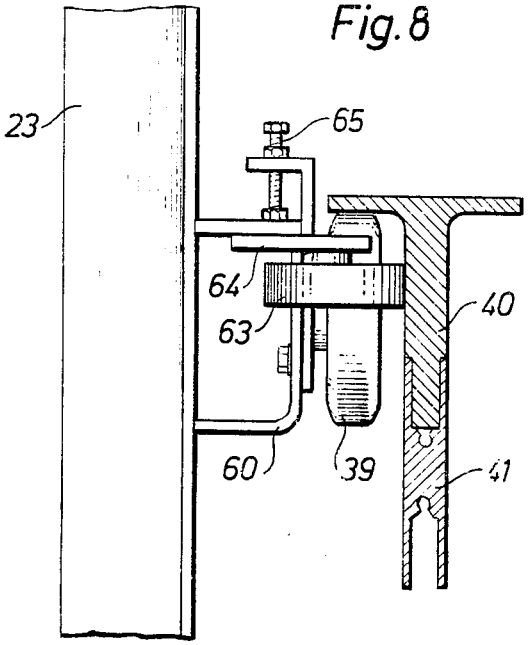
FIG. 8 is a section along the line VIII—VIII in FIG. 6.
Figure 9:
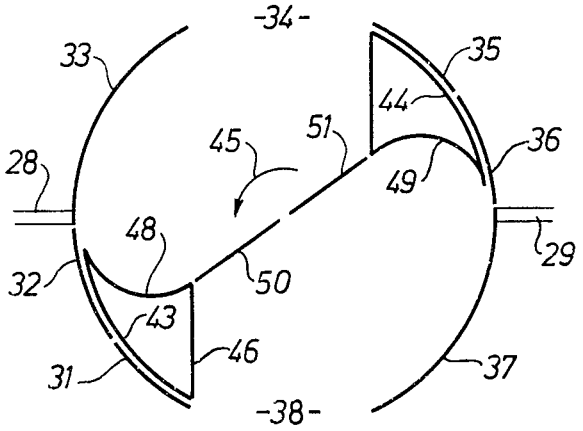
Figure 10:
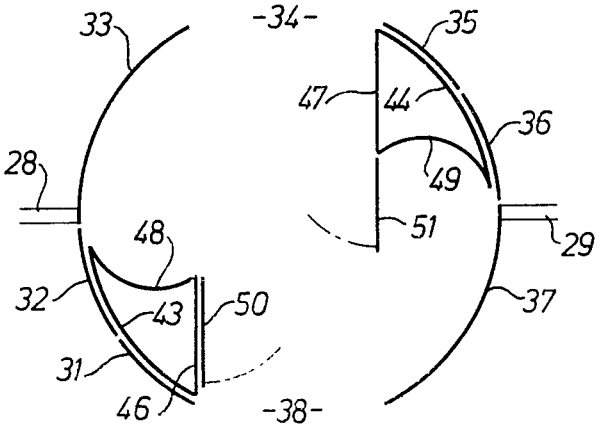

The whole of the turntable arrangement with the T-shaped rail 40 is rotated in the direction of the arrow 45 by driving means controlled primarily by sensor means 53 and 54 disposed at the posts 27 and 24, respectively, for monitoring the entrance openings 38 and 34. Two further sensor means 55 and 56 are disposed on the wall sections 46 and 47 in the direction of rotation, to enable stopping the turntable arrangement should a person or object come too near one of the movable walls 46 or 47. As will be seen from FIGS. 7 and 8, the posts 22–27 are upwardly united with each other by diagonally positioned beams 57, 58 and 59. Under the attachment means for these beams there are mounting means 60 for the rollers 39, on which one flange surface of the rail 40 rests the driving means are attached to either end of the beam 59 and consist of an electric motor 61, which is coupled by an unillustrated gear to a drive wheel 62 acting against the other flange of the T-rail 40. The electric motors are adapted for being controlled by unillustrated control equipment, to which the sensor means 53–56 are connected. The driving means is normally set such that the state illustrated in FIG. 5 prevails, i.e. such that there is free entrance to the revolving door spaces from both entrance openings 34 and 38. It is important that the rail rotates in an exactly defined path. To achieve this there are further horizontal rollers 63 mounted in members 64 attached to the respective mounting means 60. The entire mounting means is adjustable in height by a set screw 65.

The arrangement functions in the following way. It is assumed that a person passes through the entrance opening 38, thus energizing the sensor means 53, which results in that the turntable arrangement starts to move, i.e. the turntable arrangement with the T-shaped rail 40 and wall sections hanging on the frame 48 begin to rotate in the direction of the arrow 45, i.e. about a geometric axis going through the area where the doors 50 and 51 meet each other. The person can continue to move in the space in a direction towards the arcuate wall section 49, which is moving in a direction away from the person. In a given position both arcuate panels 43 and 44 cover the respective entrance openings 38 and 34. After further rotation, the openings are once again uncovered, and when rotation stops the wall section 46 will stand adjacent post 25, and the wall section 47 will stand adjacent post 22. Long before this position has been arrived at, the opening 34 has already been uncovered, so that the person can move out from the revolving door arrangement.

The following should be emphasized with regard to the safety aspects. Let it now be assumed that the revolving door is in the position illustrated in FIG. 5 and that the emergency exiting through the opening 34 has been called for. People can then move into the space inside the opening 34, which is defined by the wall sections 43, 48, 50, 51 and 47. By pressing against the doors 50 and 51 at the centre of the arrangement, these are urged from their latch engagement and can be swung out so that the door 50 will come against the wall section 46 and the door 51 against the wall sections 49 and 44. This is quite clear from FIGS. 9 and 10. As will be seen there is now a free path between the openings 34 and 38. As a result of the angular attitude of the wall sections 46 and 47 relative to the diagonal through the apparatus, there is consequently achieved that a passage is formed when the doors 50 and 51 are swung out, this passage having a width substantially the same as that of the entrance openings 34 and 38.

Figure 11:
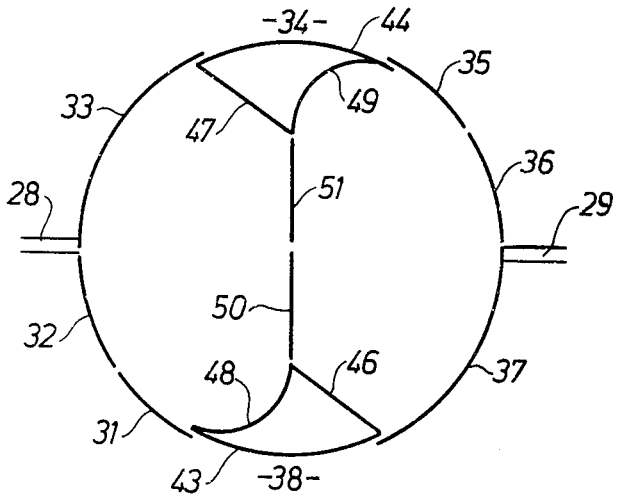
Figure 12:
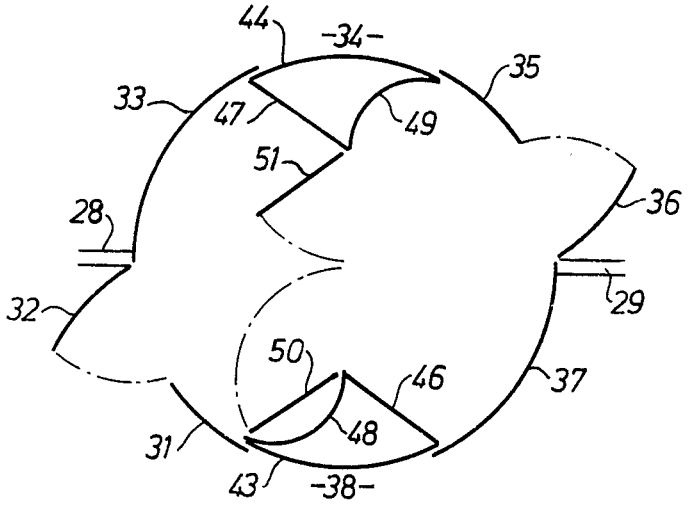

If the condition should now occur that during rotation of the revolving door both panels 43 and 44 come into a position entirely covering the openings 38 and 34, and stop in this position for some reason, persons in the spaces have the possibility of getting out even so, which is clear from the FIGS. 11 and 12. If, as before, a person has passed through the entrance opening 38 and both openings have been blocked after a given rotation, the door 36 is uncovered for opening, i.e. after being actuated it can be opened out into adjacent space. If, for some reason, exiting needs to take place through the door opposite, i.e. door 32, this can easily be done by opening the doors 50 and 51 for free passage to the adjacent space. If the arrangement has fastened in the last-mentioned position as described, and total evacuation should be necessary, this can take place even in the position now in question, by the doors 32 and 36 being opened as well as the doors 50 and 51. As will be clearly seen from FIG. 12, there is similarly formed a free passage which is substantially the same as the width of the openings for the doors 32 and 36.

If the arrangement were to jam on rotation in a position such that the arcuate panels 43 and 44 stopped directly opposite the respective post 23 and 26, a free evacuation path can be provided even so, by the doors 50 and 51 being opened. In practice, the driving means functions automatically such should there be a break in current supply, the turntable arrangement always being brought into a position such as is represented by FIG. 5. This means that the passage space can always be evacuated via one of the entrance openings 34 or 38.

As discussed in the introduction, it is important in revolving doors of the kind in question to provide as comfortable and voluminous passage space as possible, which can also be appropriate for forming a simple transport path for wheelchairs, for example. Furthermore, it is usual for customers in stores to take shopping trolleys out to the pavement or sidewalk outside a store for loading or unloading a car. It is also important here that the entry space for this purposes is also as suitable as possible. In the present case, the wall sections 46 and 47 form an angle to a diagonal line transverse the arrangement and the plan of the doors 50 and 51. By this implementation there is retained the advantageous solution obtained with this basic type of revolving door, while at the same time the available passage space will be better disposed in respect of both entrance and space in the revolving door. It may seem unjustified to arrange both curved wall sections 48 and 49 in this connection, but it has been found in conjunction with doors of the type discussed here that space apprehension is of deciding importance for avoiding claustrofobic reactions in those passing through the door. Apart from a smooth definition of the room space in the direction of movement, the curved wall sections 48 and 49 have been found to have a positive effect on persons passing through the spaces. Furthermore, the space between the wall portion 46 and the wall portion 48 as well as between wall portions 47 and 49 can be utilized for information purposes, e.g. information concerning the building to which the door leads, or for advertisement. The wall sections 46 and 47 should be openable in order to have access to the space defined by them and the wall sections 48 and 49, respectively. For troublefree operation of a structure of the kind above, it is of course important that the T-shaped rail 40 maintains its circular shape. The arcuate sector panels 42 have a decisive function here, and ensure the necessary maintanance of shape even if the frame is subjected to heavy stresses, e.g. during panic evacuation and the consequent hasty swinging open of the doors in question. By the turntable arrangement being disposed at ceiling level, and thus suspending the wall sections and doors in the revolving door arrangement, there are no thresholds or other obstacles which can cause trouble in a case of emergency exiting.

Within the scope of the invention it is of course not necessary for the wall sections 48 and 49 to have the curved shape illustrated in the embodiment, for example. These can naturally be made straight as with the wall sections 46 and 47. In certain cases, both doors 50 and 51 may be replaced by a single door pivotably suspended at the edge of one of the wall sections 46 or 47. Although though advantageous from the practical point of view, it is not necessary that the arrangement is built up on posts 22–27, and the whole turntable arrangement be suspended from a ceiling in the building in question, together with outer walls 31, 32, 33 and 35, 36, 37.

Figure 1:
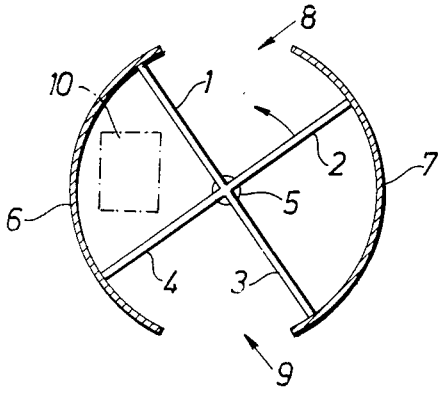
Fig.1 PRIOR ART
Figure 2:
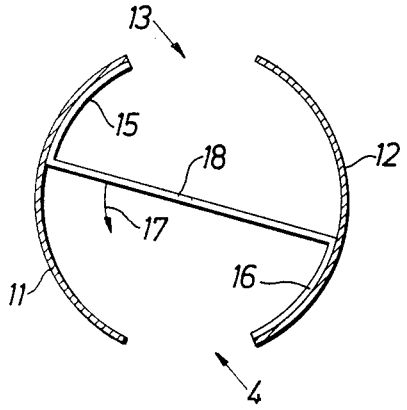
Figure 3:
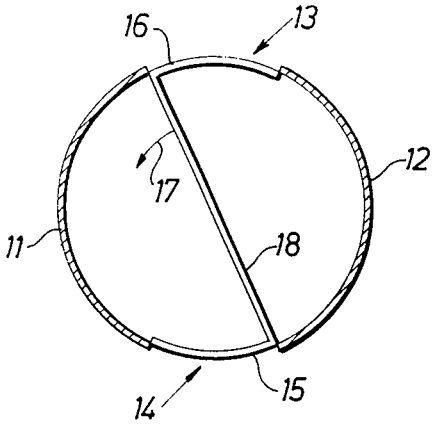
Figure 4:
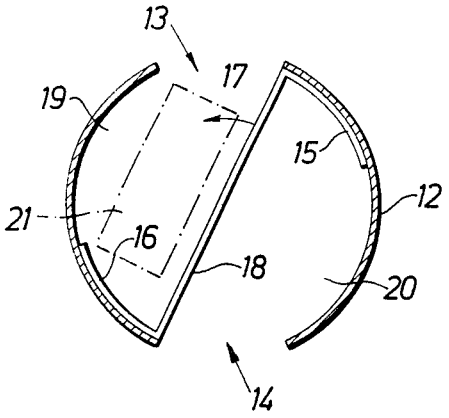

It should be emphasized here that if it is not desired to achieve greater transport capacity than with a conventional revolving door according to FIG. 1, the whole arrangement can be made considerably smaller than a conventional such door, since the passage capacity is comparatively greater. The installation dimensions can thus be reduced. Since the place for movement of objects or persons will be comparatively larger compared with conventional solutions, the periferal speed of the door can be kept low while maintaining traffic intensity.

I claim:

1. A revolving door comprising two spaced cylindrical wall sections disposed to at least partially enclose a generally cylindrical passage space having two diametrically opposed passage openings, revolving door means rotatable within said cylindrical passage space, said revolving door means comprising structure support means diametrically disposed on opposite sides of the center of said cylindrical passage space, said revolving door means further comprising door elements pivotably mounted on said structure support means for pivotal movement between open and closed positions about axes spaced from the center of said cylindrical passage space, and turntable means for rotatably supporting said revolving door means for rotary movement within said cylindrical passage space between open and closed positions, said turntable means comprising cylindrical support guide means spaced from the center of said cylindrical passage space and generally overlying the circular path of travel of said structure support means, said cylindrical support guide means rotatably engaging said structure support means to thereby rotatably support said revolving door means, said structure support means having outer panel sections which close off said passage openings when said revolving door is rotated to said closed position, said spaced cylindrical wall sections each having a pivotal door unit to provide egress from said cylindrical passage space when said revolving door is in said closed position.

2. A revolving door according to claim 1, wherein said passage openings are unblocked by said outer panel sections when said revolving door means is in said open position, said diametrically opposed passage openings defining a generally linear through passage which extends through said cylindrical passage space when said revolving door means and said door elements are in said open position, said through passage having a center line passing through the center of said cylindrical passage space, said door elements in said closed position having their inner radial edges thereof disposed adjacent to one another substantially at the center of said cylindrical passage space, said revolving door means being constructed such that when said revolving door means is in said open position and said door elements are in said closed position, said door elements are disposed in a general plane which is at an acute angle relative to said center line of said through passage.

3. A revolving door according to claim 14, wherein said outer panel sections have a partial generally cylindrical configuration, said structure support means further comprising an arcuate panel section extending from said outer panel section and a third panel section extending between said outer panel section and said arcuate panel section such that said structure support means is generally hollow, said third panel being a substantially planar panel and being substantially parallel to said center line of said through passage when said revolving door means is in said open position.

4. A revolving door according to claim 3, wherein the outer surface of said arcuate panel is concave.

5. A revolving door according to claim 3, wherein said arcuate panel is joined to an intermediate part of said outer panel section.

6. A revolving door according to claim 2, wherein the revolving door is installed within an opening in a building wall, each of said cylindrical wall sections having a generally center part which coacts with the edges of said opening in said building wall and which substantially divides said cylindrical wall section into two cylindrical wall portions, said pivotal door unit being a part of one of said cylindrical wall portions.

7. A revolving door according to claim 6, wherein said one cylindrical wall portion has a greater peripheral length than that of said pivotal door unit.

8. A revolving door according to claim 6 further comprising a support post at said center part of each of said cylindrical wall sections, said pivotal door units being pivoted at said support posts.

9. A revolving door according to claim 8, wherein each of said cylindrical wall sections have terminating edges defining said passage openings, and support posts at said terminating edges.

10. A revolving door according to claim 9, wherein said support posts support an overhead frame, and drive means mounted on said overhead frame for rotating said revolving door means.

11. A revolving door according to claim 1, wherein said structure support means comprises an arcuate panel section extending from said outer panel section and a third panel section extending between said outer panel section and said arcuate panel section such that said structure support means is thereby hollow.

12. A revolving door according to claim 11, wherein said outer panel section has a partial cylindrical configuration with an outer surface having a radius of curvature substantially equal to the radius of curvature of the inner surface of said cylindrical wall sections.

13. A revolving door according to claim 11, wherein said third panel section is substantially planar.

14. A revolving door according to claim 11, wherein said third panel section has a common edge with said arcuate panel section, and pivotal means located at said common edge for pivotably supporting said door elements.

15. A revolving door according to claim 13, wherein each of said cylindrical wall sections has two wall section ends defining said passage openings, said revolving door means having an open position in which the outer radial end of said planar third panel is disposed adjacent to one of said wall section ends.

16. A revolving door according to claim 1, wherein said cylindrical support guide means comprises roller means for rotatably suspending said revolving door means within said cylindrical passage space.

17. A revolving door according to claim 16, wherein said roller means have their axes generally horizontally disposed.

18. A revolving door according to claim 16, wherein said structure support means further comprises a support part having a generally T-shaped cross-sectional configuration, the horizontal legs of the T overlying said roller means.

19. A revolving door according to claim 18, wherein said cylindrical support guide means further comprises roller elements for guiding the peripheral path of travel of said revolving door means by engaging the vertical leg of said T.

20. A revolving door according to claim 19, wherein said roller elements have their axes generally vertically disposed.

21. A revolving door according to claim 1 further comprising drive means for rotating said revolving door means.

22. A revolving door according to claim 21 further comprising sensor means on said cylindrical wall sections for providing a signal when a person passes through said passage openings, said drive means being operable in response to said signal to rotate said revolving door means.

23. A revolving door according to claim 11, wherein said passage openings are unblocked by said outer panel section when said revolving door means is in said open position, said cylindrical passage space being divided into four portions when said revolving door means is in said open position and said door elements are in said closed position, two of said four portions being defined by the hollow structure support means, the third portion being defined by said door elements, the arcuate panel section of one of said structure support means, the third panel section of the other of said structure support means and a part of one of said cylindrical wall sections, the fourth portion being defined by said door elements, the arcuate panel section of the other of said support structure means, the third panel section of said one support structure means and a part of the other of said cylindrical wall sections, each of said third and fourth portions extending on opposite sides of a diametrical line which is perpendicular to said centerline of said through passage.

24. A revolving door comprising two spaced cylindrical wall sections disposed to at least partially enclosed a generally cylindrical passage space having two diametrically opposed passage openings, revolving door means rotatable within said cylindrical passage space, said revolving door means comprising structure support means diametrically disposed on opposite sides of the center of said cylindrical passage space, said revolving door means further comprising door elements pivotably mounted on said structure support means for pivotal movement between open and closed positions about axes spaced from the center of said cylindrical passage space, and turntable means for rotatably supporting said revolving door means for rotary movement within said cylindrical passage space between open and closed positions, said passage openings being unblocked by said structure support means when said revolving door means is in said open position, said diametrically opposed passage openings defining a generally linear through passage extending through said cylindrical passage space when said revolving door means and said door elements are in said open position, said through passage having a center line passing through the center of said cylindrical passage space, said door elements in said closed position having their inner radial edges thereof disposed adjacent to one another substantially at the center of said cylindrical passage space, said revolving door means being constructed such that when said revolving door means is in said open position and said door elements are in said closed position, said door elements are disposed in a general plane which is disposed at an acute angle relative to said center line of said through passage.

25. A revolving door comprising two spaced cylindrical wall sections disposed to at least partially enclosed a generally cylindrical passage space having two diametrically opposed passage openings, revolving door means rotatable within said cylindrical passage space, said revolving door means comprising structure support means diametrically disposed on opposite sides of the center of said cylindrical passage space, said revolving door means further comprising door elements pivotably mounted on said structure support means for pivotal movement between open and closed positions about axes spaced from the center of said cylindrical passage space, and turntable means for rotatably supporting said revolving door means for rotary movement within said cylindrical passage space between open and closed positions, said passage openings being unblocked by said structure support means when said revolving door means is in said open position, said diametrically opposed passage openings defining a generally linear through passage extending through said cylindrical passage space when said revolving door means and said door elements are in said open position, said through passage having a center line passing through the center of said cylindrical passage space, said door elements in said closed position having their inner radial edges thereof disposed adjacent to one another substantially at the center of said cylindrical passage space, said cylindrical passage space being divided into two accessible portions when said revolving door means is in said open position and said door elements are in said closed position, one of said accessible portions opening up to one of said passage openings and being defined by said door elements, a part of each of said structure support means and a part of one of said cylindrical wall sections, the other of said accessible portions opening up to the other of said passage openings and being defined by said door elements, a part of each of said structure support means and a part of the other of said cylindrical wall sections, each of said two accessible portions extending on opposite sides of a diametrical line which is perpendicular to said center line of said through passage.

* * * * *